United States Patent [19]

Gillette

[11] 4,368,214

[45] Jan. 11, 1983

[54] METHOD AND APPARATUS FOR PRODUCING ELECTRICAL CONDUCTORS

[75] Inventor: Donald J. Gillette, Guilford, Conn.

[73] Assignee: Electrostatic Equipment Corp., New Haven, Conn.

[21] Appl. No.: 273,265

[22] Filed: Jun. 12, 1981

[51] Int. Cl.[3] ..... B05D 1/06; B05D 7/20

[52] U.S. Cl. ..... 156/51; 118/634; 118/DIG. 5; 156/381; 156/499; 174/110 SR; 174/114 R; 174/117 F; 174/120 SR; 427/117; 427/118; 427/120; 427/185; 427/195; 427/375; 427/32; 428/294; 428/378; 428/379; 428/383; 156/180; 156/273.1; 156/379.7

[58] Field of Search ..... 156/51, 272, 380, 275, 156/273.1, 273.5, 273.9, 275.5, 381; 174/113 R, 114 R, 110 SR, 120 SR; 427/32, 117, 118, 120, 185, 195; 428/294, 295, 375, 378, 379, 383; 118/309, 634, 654, 629, DIG. 5, 325

[56] References Cited

U.S. PATENT DOCUMENTS

| | | | |
|---|---|---|---|
| 2,096,537 | 10/1937 | Colvin | 174/114 R |
| 3,828,729 | 8/1974 | Goodridge | 427/185 X |
| 3,916,826 | 11/1975 | Knudsen | 118/629 |
| 4,030,446 | 6/1977 | Karr | 118/654 |
| 4,131,690 | 12/1978 | Jukes et al. | 427/32 |
| 4,297,386 | 10/1981 | Gillette | 427/117 X |

*Primary Examiner*—Robert A. Dawson
*Attorney, Agent, or Firm*—Ira S. Dorman

[57] ABSTRACT

A method and apparatus are disclosed by which electrical conductor cable can be produced utilizing electrostatic coating means, which method and apparatus are highly convenient, uncomplicated and economical to carry out. An outstanding and unique feature of the cable produced in accordance herewith resides in the presence of a web portion of reduced cross-section connecting the individual conductors, by which manual severence of one from another is facilitated. Most desirably, the apparatus and method provide means for producing individual insulating coatings on each of the conductors, which means ideally utilizes an electrostatic cloud coating technique.

10 Claims, 3 Drawing Figures

METHOD AND APPARATUS FOR PRODUCING ELECTRICAL CONDUCTORS

BACKGROUND OF THE INVENTION

Modern biaxial cable consists of two parallel insulated wires embedded within a common insulating covering or sheath, such as may be of an extruded thermoplastic resin. Ideally, the outside covering for such a cable may be provided with an axially extending groove or indentation, providing a line of weakness to facilitate manual separation of the conductors, such as for splicing and to make connections to receptacles and junction boxes. The manufacture of such cable, and of other forms of insulated electrical conductors used for household and industrial wiring applications, involves operations that are difficult to control and expensive to carry out.

It is therefore a primary object of the present invention to provide a novel method and apparatus by which a common insulating coating can readily be produced upon a set of parallel wires.

A more specific object of the invention is to provide such a method and apparatus for the production of such a coating having a cross-sectional configuration which facilitates severance of the individual conductors from one another by manual tearing.

Another object of the invention is to provide such a novel method and apparatus for producing a biaxial cable consisting of two insulated conductors embedded within an exterior sheath of synthetic thermoplastic resinous material.

Yet another object of the invention is to provide such a method and apparatus which are relatively simple, and by which cable can readily be produced at high rates, with good control and at relatively low cost.

Still another object of the invention is to provide a novel cable produced by the method of the invention.

SUMMARY OF THE INVENTION

It has now been found that certain of the foregoing and related objects of the invention are readily attained in a method for the production of electrical conductor cable, utilizing a cloud of electrostatically charged particles of a fusable dielectric material. In accordance therewith, at least two continuous length conductors are continuously conveyed through or proximate such a cloud of particles. The conductors are maintained at an electrical potential which is effectively opposite to the charge carried by the particles, so as to cause them to deposit and adhere thereon. The spacing of the conductors, and the conditions of coating, are such that the particles cover the entire exterior of the conductors, including the gap therebetween. Ultimately, the particles are fused and then solidified, to produce a unified exterior coating or sheath within which the conductors are completely embedded.

In preferred embodiments of the method, the particles bridge the gap between the conductors in an area of reduced cross-section so as to produce, upon fusion and solidification, an axially extending, relatively weak web portion affording facile manual severence of the conductors. The particles utilized for coating will generally be of a thermoplastic resin, and most conveniently the cloud will be generated by fluidizing and charging a bed thereof. In most instances, the conductors exposed to coating from the first-mentioned cloud will have been previously insulated, as may be accomplished by continuously conveying bare conductors through upstream paths along which coating is effected, most desirably by an electrostatic fluidized bed technique.

Other objects of the invention are attained in a system for the continuous production of electrical conductor cables, which includes means for conveying at least two continuous length conductors along parallel paths in closely spaced proximity to one another. The system also includes means disposed along such paths for generating a cloud of electrostatically charged particles, and means for maintaining the conductors at an electrical potential suitable for causing the particles to deposit and adhere thereon. Finally, means will be provided for fusing the particles so that, upon solidification, a unified sheath is produced within which the conductors are completely embedded, and which may have an axial line of weakness to facilitate severance.

In preferred embodiments of the apparatus, the system will additionally include at least second cloud generating and particle fusing means disposed in succession along travel paths which are located upstream of the first-mentioned parallel paths. The conveying means provided will carry the conductors along the upstream paths and through or proximate the second-mentioned cloud-generating and fusing means. This will enable the production of an initial insulating coating upon each of the conductors, and most desirably the system will additionally include means for actively solidifying the fused particles of coating material.

Finally, certain objects of the invention are achieved by the provision of unique electrical conductor cable produced in accordance with the foregoing method. The cable will preferably be comprised of two individually insulated conductors, and most desirbly the outer sheath thereof will have a connecting web portion of reduced cross-section, providing an axial line of weakness.

DETAILED DESCRIPTION OF THE PREFERRED AND ILLUSTRATED EMBODIMENTS

Figure 1:
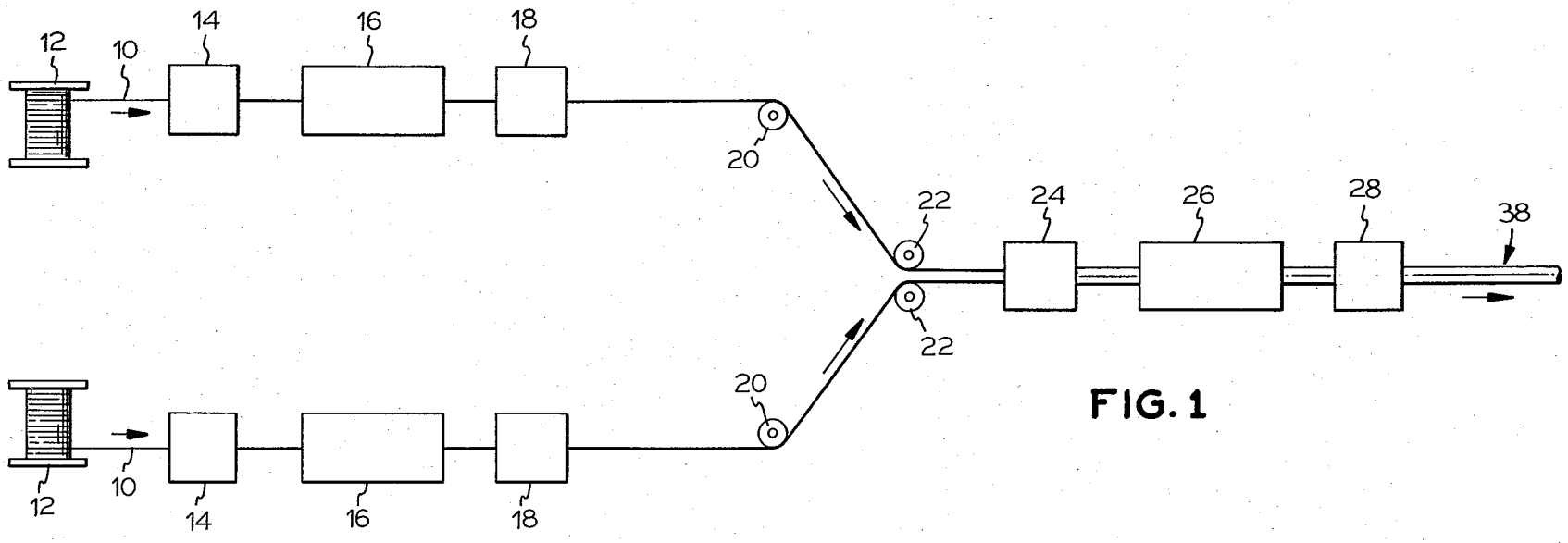
FIG. 1 is a diagrammatical representation of a system for the production of biaxial cable, embodying the method and apparatus of the present invention.

Turning now in detail to FIG. 1 of the appended drawing, therein illustrated is a coating system embodying the present invention, wherein two lengths of bare wire 10 are continuously withdrawn from supply spools 12 and conveyed through the system (by means not shown). Each wire passes through an initial coating subsystem, consisting of an electrostatic fluidized bed unit 14, in which a particulate thermoplastic coating material is deposited on the wire, an oven or heat tunnel 16, in which fusion of the particles is effected, and a cold chamber 18, in which the fused resin is solidified to produce an insulating coating. They thereafter pass about idler pulleys 20, 22, with the latter disposing the wires 10 in closely spaced proximity to one another, in which relationship they move along parallel travel paths. The two insulated wires are simultaneously exposed to a cloud of electrostatically charged particles in the unit 24, and are subsequently heated to an elevated temperature to effect fusion. This is most desirably accomplished in a tunnel 26 utilizing infra-red heaters, so as to concentrate the effect on the exterior of the assembly and thereby avoid undue softening of the previously formed insulating coatings. Finally, the wire assembly is drawn through a cooling device 28, to solidify the resin of the outside coating and produce the finished cable, generally designated by the numeral 38.

As will be appreciated, to ensure effective deposition of the charged particles, the wires 10 will be maintained at ground potential (by means now shown), in accord with standard electrostatic coating practices Typical of the electrostatic fluidized bed coating apparatus that can be utilized is that which is disclosed and claimed in U.S. Pat. Nos. 3,828,729 to Goodridge, 3,916,826 to Knudsen and 4,030,446 to Karr, such equipment being commercially available from Electrostatic Equipment Corporation of New Haven, Conn. While the fluidized beds are preferred, other electrostatic coating means, such as conventional spray equipment, may be utilized in lieu thereof.

It should be understood that the individual layers of insulation on the wires can be produced by non-electrostatic coating means; indeed, the wires may be insulated prior to introduction into the system (thus obviating the units 14, 16 and 18). Notwithstanding this, the utilization of tandem electrostatic coating means of the sort diagramatically illustrated in FIG. 1 is highly desirable from the standpoint of providing an integrated operation of utmost convenience, simplicity and economy, by which the unique products of the invention are readily produced. The resins used for the insulating coatings are not critical, and appropriate materials will be readily evident to those skilled in the art. While they must, of course, be fusible, it should be understood that the term is used in a broad sense and encompasses fusion by means other than thermal effect.

Figure 3:
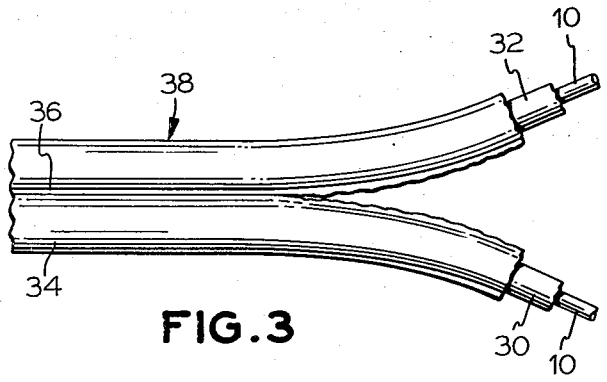
FIG. 3 is a fragmentary plan view of the cable, showing partial severence along the axially extending connecting web portion of the outer sheath.
Figure 2:
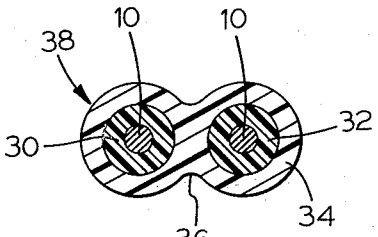
FIG. 2 is a cross-sectional view of biaxial cable produced utilizing the system of FIG. 1.

As best seen in FIG. 2, the cable 38 consists of the metal wires 10, the insulating coatings 30, 32 (desirably of different colors, typically white and black), and the exterior sheath 36 (normally of yet another color, such as brown). The sheath 34 completely surrounds the conductors (i.e., elements 10, 30, 32), and provides therebetween a connecting web portion 36, constituting an area of reduced cross-section. FIG. 3 illustrates the manner in which the two conductors can be severed from one another, and it will be understood that this is readily achieved by manually tearing along the axial line of weakness provided by the web portion 36, albeit that the tear may desirably be initiated by a shallow cut into the material of the outer covering.

Although, as has been emphasized hereinabove, the present system and method will be utilized most extensively for the production of biaxial cable, the same principles are applicable to the production of cable consisting of more than two conductors. Generally, however, the number of conductors will not exceed four and, from the standpoints of practical application and production, the cable will usually comprise either two or three conductors. In any event, during the production the the outer sheath the conductors will, of necessity, be conveyed along parallel paths and in close proximity to one another, with the gap therebetween preferably being such as will produce the relatively thin, severance-facilitating connecting web portions.

It should also be pointed out that, although the method and apparatus are most conveniently and beneficially utilized to produce a cable comprised of independently insulated conductors within an outer sheath, the conductors need not carry their own insulation. In other words, the system and method may be utilized to produce wiring wherein the only insulation on the metal wires is provided by the exterior sheath. As in the case of cable comprised of individually insulated conductors, however, such a structure will preferable be characterized by having a reduced cross-section connecting web.

Thus, it can be seen that the present invention provides a novel method and apparatus by which a common insulating coating can readily be produced upon a set of parallel wires. The exterior coating can have a cross-sectional configuration by which axial severance of the individual conductors is facilitated and, in particular, a biaxial cable consisting of two insulated conductors, embedded within an exterior sheath of synthetic thermoplastic resinous material, is readily produced. The method and apparatus of the invention are relatively simple and convenient, and they enable the production of cable at high rates, with good control, and at relatively low cost. The invention also provides a novel cable produced by the method thereof.

Having thus described the invention, what is claimed is:

1. In a method for the production of electrical conductor cable that is adapted for severance along its axis, the steps comprising:

(a) generating a cloud of electrostatically charged particles of a fusible dielectric material;

(b) continuously conveying through or proximate said cloud at least two continuous length conductors along parallel rectilinear paths in closely spaced proximity to one another with a uniform gap therebetween;

(c) maintaining said conductors at an electrical potential effectively opposite to that of said particles to cause said particles to deposit and adhere thereon, the spacing of said conductors and the conditions of coating being such that said particles completely coat said conductors and bridge said gap therebetween; and (d) fusing and thereafter solidifying said particles to produce a unified exterior coating upon said conductors, including a connecting web portion of reduced cross-section therebetween through which such severance can be effected.

2. The method of claim 1 wherein said particles are of a thermoplastic resin.

3. The method of claim 1 wherein said cloud is generated by fluidizing and charging a bed of said particles.

4. The method of claim 1 wherein said web portion is relatively weak, thereby facilitating manual severance of said conductors from one another along the axis of said cable.

5. The method of claim 1 including the additional steps of:

(e) continuously conveying at least two bare conductors along paths located upstream of said parallel paths; and (f) producing a unified insulating coating upon each of said conductors during passage along said upstream paths.

6. The method of claim 5 wherein an electrostatic fluidized bed technique is employed to produce said insulating coatings upon said bare conductors.

7. In a system for the continuous production of electrical conductor cable that is adapted for manual severance along its axis, the combination comprising:

(a) means for continuously conveying at least two continuous length conductors along parallel rectilinear paths in closely spaced proximity to one another with a uniform gap therebetween;

(b) means disposed along said paths for generating a cloud of electrostatically charged particles;

(c) means for maintaining said conductors at an electrical potential effectively opposite to that of said particles to cause said particles to deposit and adhere thereon, the spacing of said conductors and the conditions of coating being such that said particles completely coat said conductors and bridge said gap therebetween; and (d) means for fusing said particles, whereby, upon solidification of said fused particles, a unified exterior coating can be produced on said conductors, including a connecting web portion therebetween which may be of reduced cross-section and relatively weak to facilitate manual severance of said conductors from one another along the axis of said cable.

8. The system of claim 7 additionally including at least second of said cloud-generating means and of said fusing means disposed in succession along travel paths for said conductors located upstream of said parallel paths, and wherein said conveying means conveys said conductors along said upstream paths and through or proximate said second cloud-generating means and said fusing means, to enable the production of an insulating coating upon each of said conductors.

9. The system of claim 7 additionally including means for solidifying said fused particles.

10. The system of claim 7 wherein said first-mentioned fusing means comprises an infra-red heater.

* * * * *